United States Patent [19]

Möller et al.

[11] 4,078,327

[45] Mar. 14, 1978

[54] AUTOMATIC OR SEMI-AUTOMATIC SMALL ARM

[75] Inventors: Tilo Möller, Oberndorf-Lindenhof; Dieter Ketterer, Oberndorf, both of Germany

[73] Assignee: Heckler & Koch GmbH, Oberndorf, Germany

[21] Appl. No.: 730,256

[22] Filed: Oct. 6, 1976

[30] Foreign Application Priority Data

Oct. 8, 1975 Germany ..... 2544995

[51] Int. Cl.[2] ..... F41D 11/18

[52] U.S. Cl. ..... 42/71 R; 42/84; 89/1 E

[58] Field of Search ..... 89/1 R, 1 E, 7; 42/1 R, 42/71 R, 84

[56] References Cited

U.S. PATENT DOCUMENTS

| | | | |
|---|---|---|---|
| 645,932 | 3/1900 | Beck et al. | 42/84 |
| 3,859,746 | 1/1975 | Pecksen | 42/84 |

FOREIGN PATENT DOCUMENTS

| | | | |
|---|---|---|---|
| 619,756 | 3/1949 | United Kingdom | 89/7 |

*Primary Examiner*—Stephen C. Bentley
*Attorney, Agent, or Firm*—Spencer & Kaye

[57] ABSTRACT

A weapon includes a receiver which defines a dust-tight and water-tight space accommodating a barrel and a bolt assembly slidably carried by the barrel at the breech thereof. An ignition device is arranged within the space defined by the receiver for igniting, at predetermined times, combustible gases accumulating in that space.

18 Claims, 2 Drawing Figures

AUTOMATIC OR SEMI-AUTOMATIC SMALL ARM

BACKGROUND OF THE INVENTION

The present invention relates to a safety arrangement in a weapon, such as an automatic or semi-automatic small arm. The invention may find particular application in a rifle for firing caseless cartridges, having a bolt assembly which is movably mounted in the longitudinal direction of the rifle and movable relative to a barrel, further having an ammunition magazine, a cartridge feed mechanism and a trigger mechanism. The fully operational weapon system is contained in a dust and water-tight receiver designed as a stock.

A small arm of this type is disclosed in German Laid-Open Patent application (Offenlegungsschrift) No. 23 26 525.0. In this weapon, the entire, fully operation weapon system is shiftably mounted in a receiver designed as a stock. The slidability of the entire system provides accuracy advantages by eliminating or reducing recoil to a minimum during a limited number of shots or during a burst. This known small arm is also advantageous in that is satisifies more stringent demands, because the weapon system is located within the receiver and because the receiver is sealed against the external effects of dust and water. The only opening remaining is the muzzle. The receiver is only dust and water-tight, but not gas-tight.

It is a known fact that when a shot is fired, propellant gases are formed which contain combustible gas residues, in particular CO. When the bolt assembly is opened, there may still be considerable pressure in the barrel, which causes the residual gases to flow out at the chamber end instead of toward the muzzle. If the chamber, like the bolt assembly, is located in a sealed receiver, combustible gas residues can also flow into the receiver. Although, as a result, a pressure buildup takes place in the receiver, the upper pressure limit remains far below the rupturing pressure of the receiver, even if large numbers of shots are fired, since the receiver is not sealed gas-tight. It has been found, however, that when the gas mixture located in the receiver is ignited, for example, as a result of the ejection of powder particles which are still burning, the pressure in the receiver can increase considerably, which should be avoided. This increase in pressure caused by ignition of the gas mixture contained in the receiver cannot be controlled with an overpressure valve, as the rate of increase of the pressure is very great and the cross-sectional area available for an overpressure valve is relatively small. In addition, an overpressure valve of this type would be a source of malfunctions as a result of a failure to seal, caused, for example, by sand.

SUMMARY OF THE INVENTION

It is an object of the present invention to design a weapon, particularly a small arm of the type described at the outset in such a manner that no excessively high overpressure can occur in the receiver, even if residual propellant gases are ignited.

This object and others to become apparent as the specification progresses, are achieved by the invention, according to which, briefly stated, the weapon includes an ignition device arranged within a space defined by the receiver for igniting, at predetermined times, combustible gases accumulating in that space.

One advantage of a small arm designed in accordance with the present invention is that the receiver does not need an additional opening, and yet the danger of excessive overpressures is nevertheless avoided. By means of frequent ignition by the ignition device, minor quantities of ignitable gas mixture which may accumulate are burned before the volume of gas is large enough to result in dangerous pressure when combusted. Especially if, in a preferred embodiment of the invention, the ignition means is actuated as a function of the firing sequence, it is possible to ensure that even very minor quantities of combustible mixture are ignited, and thus safely burned. Since an egress of gases from the barrel into the receiver is unavoidable and it is not feasible to eliminate the possibility that, first, an ignitable gas/air mixture ratio can result, and, second, mechanically generated sparks or burning powder particles can be present, regularly combusting the ignitable gas mixture represents a possibility of eliminating overloads and damage to the weapon, in particular the receiver. By actuating the ignition means as a function of the firing sequence, for example after every shot or burst, it is possible to ensure that the gases are ignited at the lower ignition mixture limit, causing the combustion to be relatively quiet and free of high pressure peaks. This avoids endangering either shooter or weapon. In addition, a surprising advantage can be seen in the fact that after only a few ignitions, the mixture is no longer ignitable, as the percentage of oxygen has become too low. The gases flowing in from the barrel contain too little oxygen if at all, and no air can penetrate into the receiver from the outside, as an overpressure prevails in the receiver. Air can penetrate only if no shot is fired for a certain length of time, and thus overpressure in the receiver relative to the atmosphere has been completely eliminated. However, an actuation of the ignition means after the first shot or burst, causes the gas to be ignited, as described above, as soon as it is ignitable, thereby gradually reducing the percentage of oxygen so greatly that the gas in the receiver is no longer ignitable.

The ignition means can be of widely varying design and arrangement. In a preferred embodiment of the invention, in which the small arm is designed as a gas-operated weapon, the ignition means are arranged in the area between the bolt assembly and a gas piston of the gas-operated action. It is preferable for the ignition means to be actuated by the bolt assembly or the bolt assembly drive (action). This permits the ignition means to be actuated as a function of the firing sequence in a very simple manner.

The ignition means may comprise a battery for supplying voltage to a spark gap by means of a capacitor charging circuit or a coil with contact breaker. The use of batteries, however, is problematic if the small arm is an army weapon, as in this case the weapon is required to operate dependably even after many years of storage; yet, no batteries are available which can retain their charge for a storage period of such length. It is also conceivable to cause ignition by means of mechanically generated sparks, for example, by means of a flint as in a cigarette lighter. However, such a design of the ignition means would result in the disadvantage that the spark energy would be relatively low and the reliability of operation and ignition would not be sufficiently high. For this reason, in a preferred embodiment of the invention, the ignition means comprise at least one piezoelectric crystal, which is connected with a spark gap in an electrically conductive manner and which is subjected to a mechanical impact by a percussive member for generating a charge which produces a spark capable of causing ignition. With ignition means of this design, the small arm according to the present invention can be stored indefinitely, which means that it is readily capable of immediate service, even after years of storage. In addition, ignition means of this type are of simple design, and therefore dependable. Further, ignition means of this design can be manufactured economically.

In a preferred embodiment of the ignition means, there are two piezoelectric crystals, connected one opposite the other (back-to-back) electrically and one behind the other mechanically; an insulated lead extends to a first pole of a spark gap from an electrode on those end surfaces of the two crystals which face one another. A second pole of the spark gap and the two end surfaces of the two crystals facing away from one another maybe connected by ground. The use of two piezoelectric crystals increases both the electric output and the reliability of the weapon if the arrangement is dimensioned in such a manner that the spark generated by one crystal is still sufficient for ignition. Even if one of the two crystals should fail, e.g. as a result of a short circuit, the other will still always provide dependable ignition.

An advantage of an electrical ignition process of this type is that the zone where the electrical energy is generated and the location of the electrical discharge, i.e. the location of the spark gap, can be freely selected, since it is sufficient to lead an insulated wire to the spark gap from the energy converter generating the electrical energy. It is therefore possible to arrange the spark gap in an optimum position for igniting the gas mixture, without having to take the location of the energy converter into consideration. In a preferred embodiment of the invention, the spark gap is therefore arranged, for example, in the vicinity of the bolt assembly. This is the zone in which the highest gas concentrations are to be expected, so that the limit of an ignitable gas mixture will be reached here first. If, in addition, the point in time at which the spark is generated is expediently selected, which is very simple to achieve, the gas mixture ignites long before a stoichiometric mixture ratio is reached. After only a few ignition cycles, the mixture contains so little air that it can no longer be ignited. If the percentages of $CH_4$ and $H_2$, which are also present, although in minor quantities, are ignored and if only the CO, which represents the major percentage of combustible gas, is taken into consideration, the limit at which the mixture can no longer be ignited is reached at a percentage of air of less than 26%.

The percussive member performing the mechanical blow against the piezoelectric crystal or piezoelectric crystals can be of varying design and arrangement. For example, it can be designed as a hammer which is tripped at a given point in time, for example, as a function of the actuation of the bolt assembly. Arming (cocking) of the hammer, too, can be effected as a function of the actuation of the bolt assembly. The percussive member can further be designed as a mass which is moved directly by the action. In a preferred embodiment of the invention, in which the small arm is designed as a gas-operated weapon, the percussive member is designed as a force limiter, which can be moved together with the gas piston of the gas-operated action. The force limiter comprises a longitudinally slidable ram, whose head is oriented towards the piezoelectric crystals and which is forced toward the piezoelectric crystals by a spring. As a result of its kinetic energy, the ram transmits a sufficient pulse to the piezoelectric crystal(s); the spring permits the gas piston to continue to travel and move relative to the force limiter. It is also possible to use buffer means of the gas-operated action as the percussive member, as these means are present in any event. In general, however, it is expedient to use a separate force limiter, as it can be provided with little effort and expense.

DESCRIPTION OF THE PREFERRED EMBODIMENTS

Figure 1:
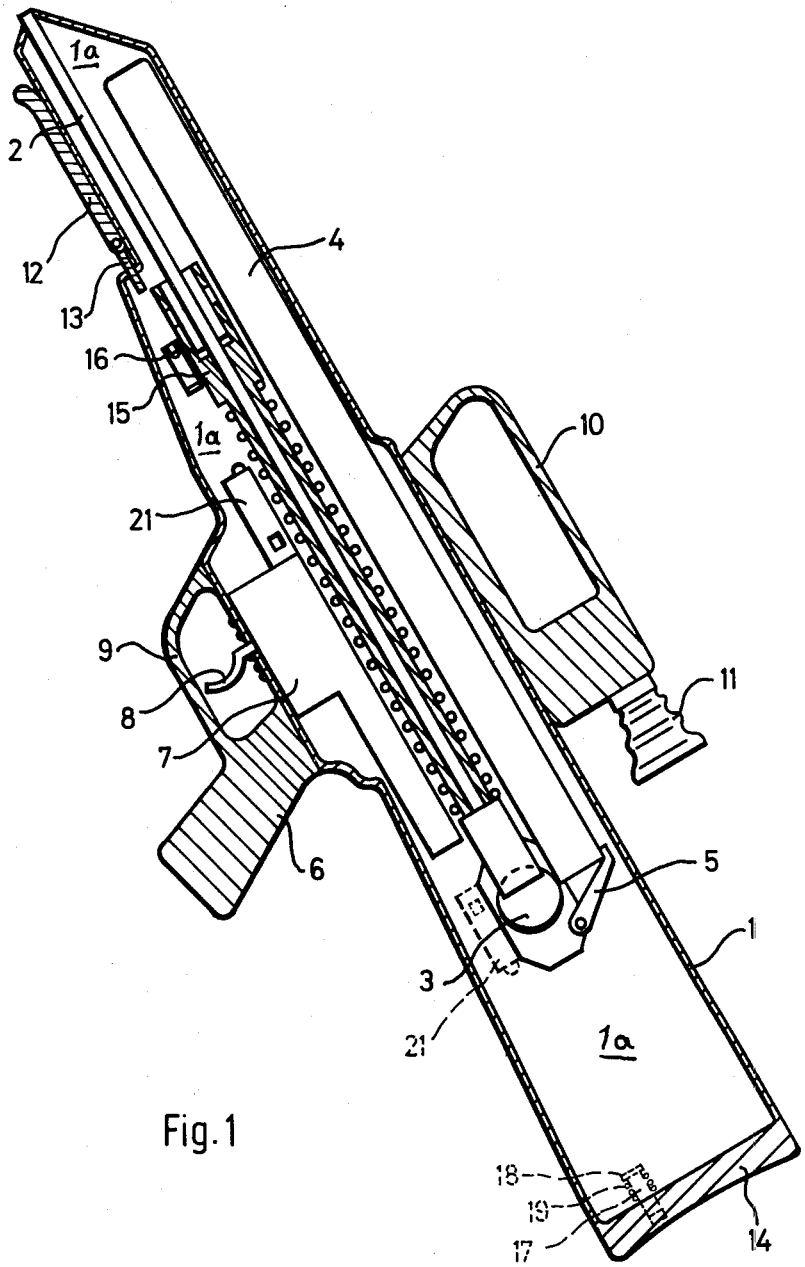
FIG. 1 is a schematic longitudinal sectional view of a small arm incorporating the invention.

Referring now to FIG. 1, there is shown a schematic representation of a practical example of an automatic rifle, having a weapon system contained in the space 1*a* of an essentially dust and water-tight receiver 1. The weapon system comprises a barrel 2, a cylindrical bolt assembly 3, a magazine 4, arranged parallel to the barrel, a cartridge feed mechanism 5 and a housing 7 with a portion of the trigger mechanism, whose trigger 8 extends to the outside through the receiver 1. A pistol grip 6, including a trigger guard 9 surrounding trigger 8, is attached to the receiver 1 in the vicinity of the trigger 8. Attached at the top of receiver 1, opposite piston grip 6, is a carrying handle 10 with sights 11. The magazine 4 is arranged above the barrel, with a cocking lever 12 provided outside the receiver, beneath barrel 2, in the area of the muzzle; an actuating member 13 extends from cocking lever 12 through the receiver in a sealed manner, to the inside and to cylindrical bolt assembly 3. This weapon system which is disclosed in the above-mentioned German Laid-Open application No. 23 26 525.0, is capable of firing a plurality of shots (burst) during the rearward travel of the weapon system from a forward limit position to a rearward limit position. Upon firing each shot of the burst, the bolt assembly 3, driven by the gas piston 3 of the gas-operated action and a return spring, executes a reciprocating motion with respect to the barrel 2. The bolt assembly 3 may be essentially of the structure, which is disclosed in the above-mentioned German Laid-Open application No. 23 26 525.0 or as disclosed in the German Laid-Open application No. 24 13 615.0. Further, the weapon is an automatic rifle for firing caseless cartridges. This eliminates the need for a case ejection port, which would result in sealing problems. In addition, the space between the cylindrical bolt assembly 3 and a butt stock 14, which closes the rear of receiver 1, can be utilized for the recoil of the weapon system if caseless ammunition is fired. If case-type ammunition or ammunition with a case head were fired, the space could be used for collecting the empty cases or case heads.

The gas piston 15 has a downwardly directed projection 16 containing a bore hole extending parallel to the barrel. A ram 17 with a head 18 is longitudinally slidably guided in the bore hole. A helical compression spring 19 surrounding the shank of ram 17 is arranged between projection 16 and head 18 to urge the ram 17 in the direction of butt stock 14, causing a collar 20 arranged on ram 17, at the opposite end of head 18, to come into a contacting relationship with the end surface of projection 16.

Piezoelectric ignition means 21 are arranged between trigger assembly housing 7 and the force limiter formed of the ram 17 and helical compression spring 19.

Figure 2:
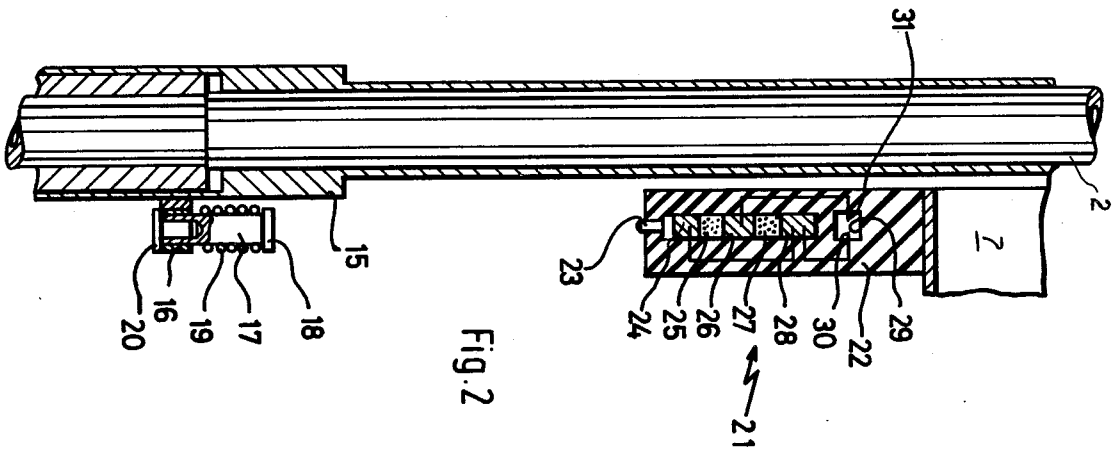
FIG. 2 is a schematic longitudinal sectional view of a preferred embodiment of the invention.

Turning now to FIG. 2, the piezoelectric ignition means 21 comprise a housing block 22 which is attached to the outside of the housing 7 and which contains a longitudinal hole extending parallel to barrel 2. It is noted that the housing 7, as part of the above-discussed weapon system, moves with the barrel 2 as a unit. The longitudinal hole of the block 22 is designed as a blind hole which opens in the direction of head 18 of ram 17, but which is closed off by means of a pressure pin 23 is adjoined by a metal insert 24, which, in turn, is adjoined by a piezoelectric crystal 25. The latter is adjoined by a central electrode 26, which, in turn, is adjoined by a piezoelectric crystal 27. A further metal insert 28 is arranged between piezoelectric crystal 27 and the base of the blind hole. Piezoelectric crystals 25 and 27 are arranged in such a manner that when a force acts on the pressure pin 23, identical charges are formed on those end surfaces of piezoelectric crystals 25 and 27 which face the central electrode 26 and are in engagement therewith.

The housing block 22 comprises a body of insulating material, containing a further opening 29, which extends generally tangential to the axis of barrel 2 and which is in continuous communication with the space enclosed by the receiver 1. Two discharge electrodes 30 and 31 extend into opening 29. The electrode 30 is electrically connected with the two metal inserts 24 and 28, while the electrode 31 is electrically connected with the central electrode 26. The discharge electrodes 30 and 31, which are located one opposite the other with a given clearance, define a spark gap, across which the charges generated on piezoelectric crystals 25 and 27 are discharged by drawing a spark.

When a shot is fired, the resulting gas pressure moves the gas piston 15 toward the cylindrical bolt assembly 3. During the course of this motion, head 18 of ram 17 strikes the pressure pin 23 which transmits a force — that is proportional to the delay of ram 17 — to the column of piezoelectric crystals. The resulting charges on the end surfaces of piezoelectric crystals 25 and 27 are equalized by a spark between discharge electrodes 30 and 31, which ignites any ignitable gas mixture which is present. It is thus seen that in this weapon, which, as explained above, is capable of firing a burst while the barrel travels rearwardly, the ignition means is actuated subsequent to the firing of each shot, since the percussive member 17, 18 is carried by the gas piston 15 which executes separate reciprocating movements upon the firing of each shot of the burst. If it is desired that the ignition means operate not after each shot but only after each burst of shots, the percussive member is secured, for example, to the rearward end of the barrel, or of the bolt assembly resp., whereas the igniting device proper is secured, for example, to the inner face of the butt 14, or vice versa as is shown in dotted lines in FIG. 1. After the last shot of the burst is fired, the barrel and the bolt will have travelled sufficiently rearwardly to cause actuation (by the percussive member carried thereby) of the igniting device.

Obviously, many modifications and variations of the present invention are possible in the light of the above teachings without departing from the scope of the present invention. It should therefore be understood that, within the scope of the appended claims, the invention may be practiced otherwise than as specifically described. In particular, individual characteristics of the present invention can be used either individually or in combination. The salient feature of the present invention is that a spark is repeatedly generated in an enclosed space, into which gas containing ignitable components is introduced in batches; the spark causes the gas mixture to ignite as soon as it reaches the limit of inflammability. This maintains the pressure increase which occurs in connection with combustion of the gas mixture relatively low, on the one hand, and provides a mixture which is no longer flammable after a few ignition processes because of a lack of oxygen, on the other hand. This prevents a damaging increase in pressure in the enclosed space.

What is claimed is:

1. In a safety arrangement for a weapon to prevent accidental ignition of potentially dangerous quantities of combustible gases generated during firing of the weapon and accumulating therein; the weapon including a dust-tight and water-tight receiver; a barrel; a bolt assembly slidably carried by the barrel at the breech end thereof; the bolt assembly being arranged for longitudinal recriprocation with respect to the barrel when a shot is fired; the barrel and the bolt assembly being accommodated within the receiver; a space being surrounded and defined by the receiver and being situated externally of the barrel and the bolt assembly; the improvement comprising ignition means disposed within said space and being in operative communication therewith for igniting, at predetermined times, said combustible gases filling said space.

2. A safety arrangement for a weapon as defined in claim 1, wherein said ignition means includes actuating means for igniting the combustible gases in said receiver as a function of weapon firing.

3. A safety arrangement for a weapon as defined in claim 2, wherein said actuating means is arranged for operation by a component of the weapon upon firing each shot.

4. A safety arrangement for a weapon as defined in claim 2, wherein said actuating means is arranged for operation by a component of the weapon upon firing a plurality of shots.

5. A safety arrangement for a weapon as defined in claim 2, wherein said actuating means includes a mechanism coupled to a weapon component executing a displacement caused by weapon firing.

6. A safety arrangement for a weapon as defined in claim 5, wherein said weapon component is said bolt assembly.

7. A safety arrangement for a weapon as defined in claim 6, wherein said mechanism is arranged for actuation by said bolt assembly at a moment when said bolt assembly is in an open position with respect to the breech.

8. A safety arrangement for a weapon as defined in claim 5, including an action for longitudinally displacing said bolt assembly after firing each shot, said weapon component being said action.

9. A safety arrangement for a weapon as defined in claim 8, wherein said action includes a gas-operated piston, said mechanism being coupled to said piston.

10. A safety arrangement for a weapon as defined in claim 8, wherein said mechanism is arranged for actuation by said action at a moment when said bolt assembly is in an open position with respect to the breech.

11. A safety arrangement for a weapon as defined in claim 9, wherein said ignition means is disposed in the zone between said bolt assembly and said gas-operated piston.

12. A safety arrangement for a weapon as defined in claim 2, wherein said ignition means includes a piezoelectric crystal, a spark gap and conductor means electrically connecting sid crystal with said spark gap; said actuating means including a percussive member arranged for imparting a mechanical blow on said crystal for generating a voltage; said voltage being applied by said conductor means to said spark gap for drawing an igniting spark thereacross.

13. A safety arrangement for a weapon as defined in claim 12, wherein said spark gap is disposed in the vicinity of said bolt assembly.

14. A safety arrangement for a weapon as defined in claim 12, including a gas-operated action for longitudinally displacing said bolt assembly after each shot is fired, a buffer mechanism forming part of said gas-operated action, said buffer mechanism being arranged to constitute said percussive member.

15. A safety arrangement for a weapon as defined in claim 12, including a gas-operated action having a gas-operated piston for longitudinally displacing said bolt assembly after firing each shot, a force limiter attached to said piston and movable therewith as a unit, said force limiter constituting said percussive member.

16. A safety arrangement for a weapon as defined in claim 15, wherein said force limiter comprises a ram arranged on said piston for displacement with respect to said piston in the direction of its path of travel, said ram having an impacting head oriented towards said piezoelectric crystal; said force limiter further including a spring urging said ram in the direction of said piezoelectric crystal.

17. A weapon as defined in claim 1, wherein said ignition means includes a. first and second piezoelectric crystals each having opposite first and second faces; said first faces being oriented towards one another and said second faces being oriented away from one another;

b. a central electrode disposed between said crystals and electrically connected to said first faces;

c. a spark gap formed of spaced discharge electrodes;

d. first conductor means electrically connecting said central electrode with one of said discharge electrodes;

e. second conductor means electrically connecting said second faces of said piezoelectric crystals with another one of said discharge electrodes; and f. a movably mounted percussive member for imparting, at least indirectly, a mechanical blow to said piezoelectric crystals for generating opposite polarities on said first and second faces of said piezoelectric crystals for applying a spark discharge voltage across said discharge electrodes; said piezoelectric crystals being arranged one behind the other when viewed in the direction of movement of said percussive member.

18. A safety arrangement for a weapon as defined in claim 17, including a gas-operated action having a gas-operated piston for longitudinally displacing said bolt assembly after each shot is fired, said percussive member being carried by said gas-operated piston; said barrel being movably supported in said receiver for executing a longitudinal displacement upon weapon firing; a housing block accommodating said piezoelectric crystals, said central electrode, said spark gap and said first and second conductor means; said housing block being arranged for movement with said barrel as a unit.

* * * * *